US006123998A

United States Patent [19]

Takahashi et al.

[11] Patent Number: 6,123,998

[45] Date of Patent: Sep. 26, 2000

[54] CERAMIC COATING METHOD FOR METALLIC SUBSTRATE UTILIZING A TRANSITIONAL LAYER OF CERAMIC-METAL

[75] Inventors: Masashi Takahashi; Yoshiyasu Itoh; Takanari Okamura, all of Yokohama, Japan

[73] Assignee: Kabushiki Kaisha Toshiba, Kawasaki, Japan

[21] Appl. No.: 08/779,117

[22] Filed: Jan. 6, 1997

Related U.S. Application Data

[63] Continuation of application No. 08/425,779, Apr. 20, 1995, abandoned, which is a continuation of application No. 08/103,633, Aug. 11, 1993, abandoned.

[30] Foreign Application Priority Data

Aug. 12, 1992 [JP] Japan ..... 4-214422

[51] Int. Cl.[7] ..... B05D 1/08

[52] U.S. Cl. ..... 427/446; 427/376.3; 427/376.4; 427/456

[58] Field of Search ..... 427/446, 454, 427/456, 376.3, 376.4, 419.3

[56] References Cited

U.S. PATENT DOCUMENTS

| | | | |
|---|---|---|---|
| 3,020,182 | 2/1962 | Daniels | 427/453 |
| 3,091,548 | 5/1963 | Dillon, II | 117/70 |
| 3,719,519 | 3/1973 | Perugini | 117/71 M |
| 4,109,031 | 8/1978 | Marshcer | 427/191 |
| 4,152,223 | 5/1979 | Wallace et al. | 204/37 R |
| 4,246,323 | 1/1981 | Bornstein et al. | 427/456 |
| 4,405,659 | 9/1983 | Strangman | 427/453 |
| 4,457,948 | 7/1984 | Ruckle et al. | 427/34 |
| 4,687,678 | 8/1987 | Lindblom | 427/453 |

FOREIGN PATENT DOCUMENTS

| | | |
|---|---|---|
| 175750 | 4/1986 | European Pat. Off. . |
| 217991 | 4/1987 | European Pat. Off. . |
| 455996 | 11/1991 | European Pat. Off. . |
| 272314 | 10/1989 | Germany . |
| 85/04428 | 10/1985 | WIPO . |

*Primary Examiner*—Brian K. Talbot
*Attorney, Agent, or Firm*—Foley & Lardner

[57] ABSTRACT

A ceramic coating method for coating a ceramic on a metallic substrate is disclosed where a ceramic material is coated on a surface of a metallic substrate by continuously changing the composition of a mixture of a ceramic material and a metal to form a ceramic coating film on a surface of the metallic substrate. A heat treatment then is effected to the ceramic coated metallic substrate so as to induce a residual stress due to compression on a surface of the ceramic coating film, thereby improving the durability of the ceramic coating film.

15 Claims, 6 Drawing Sheets

| | COATING MATERIAL | FILM THICKNESS LIMIT UP TO PEELING OFF (mm) |
|---|---|---|
| TWO-LAYER COATING MATERIAL | $ZrO_2$/NiCrAlY | 0.78 |
| | $ZrO_2$/CoNiAlY | 0.88 |
| | $ZrO_2$/NiCr | 0.61 |
| | $ZrO_2$/CoCrAlY | 0.49 |
| | $ZrO_2$/NiCoCrAlY | 0.42 |
| | $ZrO_2$/Ni | 0.44 |
| COATING MATERIAL HAVING CONTINUOUSLY CANGING COMPOSITION | $ZrO_2$/NiCrAlY | 4.93 |
| | $ZrO_2$/CoNiAlY | 4.11 |
| | $ZrO_2$/NiCr | 4.29 |
| | $ZrO_2$/CoCrAlY | 3.09 |
| | $ZrO_2$/NiCoCrAlY | 3.97 |
| | $ZrO_2$/Ni | 4.76 |

FIG. 3

| THERMAL CYCLE TEST | TWO LAYER COATING | CONTINUOUSLY CHANGING OF COMPOSITION (NO HEAT TREATMENT) | CONTINUOUSLY CHANGING OF COMPOSITION (HEAT TREATMENT) |
|---|---|---|---|
| 1 TIME | HEXAGONAL CRACKS | NO CRACK | NO CRACK |
| 2 TIMES | —— | NO CRACK | NO CRACK |
| 10 TIMES | —— | VERTICAL CRACKS | NO CRACK |
| 100 TIMES | —— | —— | NO CRACK |

FIG. 6

CERAMIC COATING METHOD FOR METALLIC SUBSTRATE UTILIZING A TRANSITIONAL LAYER OF CERAMIC-METAL

This application is a continuation of application Ser. No. 08/103,633, filed Aug. 11, 1993 now abandoned, which in turn is a continuation of application Ser. No. 08/425,779, filed Apr. 20, 1995 now abandoned.

BACKGROUND OF THE INVENTION

The present invention relates to a ceramic coating method for coating a ceramic material to a metallic substrate, to obtain a coating film excellent in durability free of film cracks and peeling, in which ceramic coating onto a metallic substrate is performed by forming a coating film by continuously changing the composition ratio of ceramic and metal and then performing heat treatment to thereby induce residual stress due to compression on the ceramic coating film surface.

Recently, a technique of ceramic coating on a metallic substrate has prevailed to improve such functions or characteristic features as heat resistance, corrosion resistance and wear resistance, and this technique has been widely applied. However, a ceramic film formed by using various conventional coating processes is fragile and likely to cause cracks and peeling. Thus, ceramic coating effect is not utilized sufficiently and such defects often lead to a trouble during the coating process. Particularly, when a coated material is exposed to a high temperature environment during its use, a thermal stress occurs as a result of a difference in thermal expansions between the metallic substrate and the ceramic coating film as well as of external stress, thereby worsening the coating condition.

In view of above points, in a composite material composed of a plurality of materials like a coating material, some trials have been made to reduce the thermal stress caused by a difference in the coefficients of linear expansion of composing material. For example, Japanese Patent Laid-open (KOKAI) Publication No. 4-214826 and No. 4-337011 disclose techniques intending to reduce the thermal stress by eliminating sudden changes of such physical properties as the coefficient of linear expansion and Young's modulus by changing the composition on the interface between two materials. Namely, both are related to the production of material having a composition being changed continuously.

The Japanese Patent Laid-open (KOKAI) Publication No. 4-214826 discloses a technique for achieving the gradient composition of two materials by an infiltration of low-melting point material into pores after producing a high-melting point material having continuously changing porosity. The Japanese Patent Laid-open (KOKAI) Publication No. 4-337011 discloses a method intended to finish into an optional shape by a plastic forming working such as extrusion, drawing and rolling working after a gradient composition block has been produced using a sintering method which relatively facilitates gradient composition and is a production method suitable for a large member having a composition changing continuously in its longitudinal dimension.

On the other hand, in some trials, the same concept is adapted to the ceramic coating material to relax the thermal stress by changing the composition on the interface between the substrate and the ceramic coating film. As a coating process for continuously changing the composition, a plasma spray coating method, a PVD method and a CVD method are known to be effective as methods which enable the coating by controlling the production conditions (e.g., Bulletin of the 4th Gradient Function Material Symposium, pp. 149, pp. 119). Additionally, it is also known that optimization of composition change is effective to relax thermal stress (the 4th Gadient Function Material Symposium, pp. 19).

As described above, various trials have already been done to prevent cracks and peeling of the film from occurring due to the thermal stress during the use of the ceramic coating film. However, in the prior art, these trials have been made from the viewpoint of reducing thermal stress caused in the coating process. On the other hand, it is generally known that the residual stress occurs depending on the heat history during the ceramic coating process. Naturally, the residual stress distribution caused in a film during the coating process is considered to affect the characteristics of film cracks and peeling. Thus, it is important to establish a coating method and a coating condition considering the residual stress in the coating process in order to form a coating film having an excellent durability free of cracks and peeling.

SUMMARY OF THE INVENTION

An object of the present invention is to substantially eliminate defects or drawbacks encountered in the prior art and to provide a ceramic coating method for a metallic substrate ensuring the provision of excellent durability free of cracks and peeling by performing heat treatment after ceramic coating to induce compression residual stress in the coating film.

This and other objects can be achieved according to the present invention by providing a ceramic coating method for coating a ceramic on a metallic substrate comprising the steps of:

coating a ceramic material on a surface of a metallic substrate by continuously changing the composition of a mixture of a ceramic material and a metal to form a ceramic coating film on a surface of the metallic substrate; and effecting a heat treatment to the ceramic coated metallic substrate so as to induce a residual stress due to compression on a surface of the ceramic coating film, thereby improving durability of the ceramic coating film.

In preferred embodiments, the ceramic material is a ceramic oxide having a coefficient of linear expansion smaller than that of the metallic substrate to induce the residual stress at the heat treatment.

The metallic substrate is formed of a heat resistant alloy of element substantially selected from a group consisting of Fe, Co or Ni. A metal component of the mixture composition of the ceramic and a metal of an intermediate layer formed during the continuous coating process between the surface of the substrate and a final coating surface is formed of a heat resistant alloy of element substantially selected from a group consisting of Fe, Co or Ni. The ceramic material or the mixture composition is coated on the surface of the metallic substrate by means of a plasma spray coating method. The coating film of the mixture composition of the ceramic and the metal is formed under an environment having a partial oxygen pressure of less than $10^{-3}$ Torr.

The heat treatment is effected with a temperature within 600–1300° C. and the heat treatment is effected at a pressure (atmospheric pressure) more than a normal pressure to carry out an a hot isostatic pressing (HIP) treatment.

The method may further comprise a step of coating a high temperature resistant oxidizing material film to improve the high temperature resistant oxidization characteristic of the coating material. This step may be done during the coating process of the ceramic material or after the coating process of the ceramic material. The high temperature resistant material is a material selected from a platinum group element such as Pt or Ir.

The high temperature resistant material is formed of a stable alloying material forming a stable passive film, and the stable alloying material is Al or Cr and the stable passive film is formed of $Al_2O_3$ or $Cr_2O_3$ at a portion having an equal coefficient of linear expansion when the ceramic or mixture composition of the ceramic and the metal is coated.

According to the present invention of the characters described above, since the coating ceramic material has a coefficient of linear expansion smaller than that of the substrate, the compression residual stress can be induced to the ceramic coating film, and moreover, the absolute value of this residual stress and the distribution thereof can be optimumly changed by changing the heat treating temperature, the kind of the ceramic material to be coated, the mixed composition ratio and distribution of the material.

Furthermore, at the time of coating the ceramic or the mixture composition of the ceramic and the metal, by additionally effecting the coating step for coating an alloy including, for example, Al or Cr forming a stable passive film such as platinum group metal of Pt or Ir or $Al_2O_3$ or $Cr_2O_3$, the high-temperature oxidization characteristic can be improved with the compression residual stress being maintained to the ceramic coating film. This coating process may be performed by a plating method, a vapour phase method, a spraying method or the like.

The coating material according to this coating method can be preferably utilized as a material for a part of a gas turbine operated under high-temperature and corrosive environment to reduce the causing of cracks and peeling of the coating film, thus providing an excellent durability, resulting in the improvement of the life time of the gas turbine itself and the enhancement of the energy efficiency of the gas turbine.

The nature and further characteristic features of the present invention will be made more clear hereunder through the descriptions made through a preferred embodiment with reference to the accompanying drawings.

BRIEF DESCRIPTION OF THE DRAWINGS

In the accompanying drawings:

FIG. 3 is an explanatory view of a film thickness limit of a two-layer coating material and a coating material having a continuously changed composition ratio in accordance with the plasma spray coating method;

FIG. 6 is an explanatory view showing a result of thermal cycle tests performed for layer coating materials, respectively.

DESCRIPTION OF THE PREFERRED EMBODIMENTS

Figure 1:
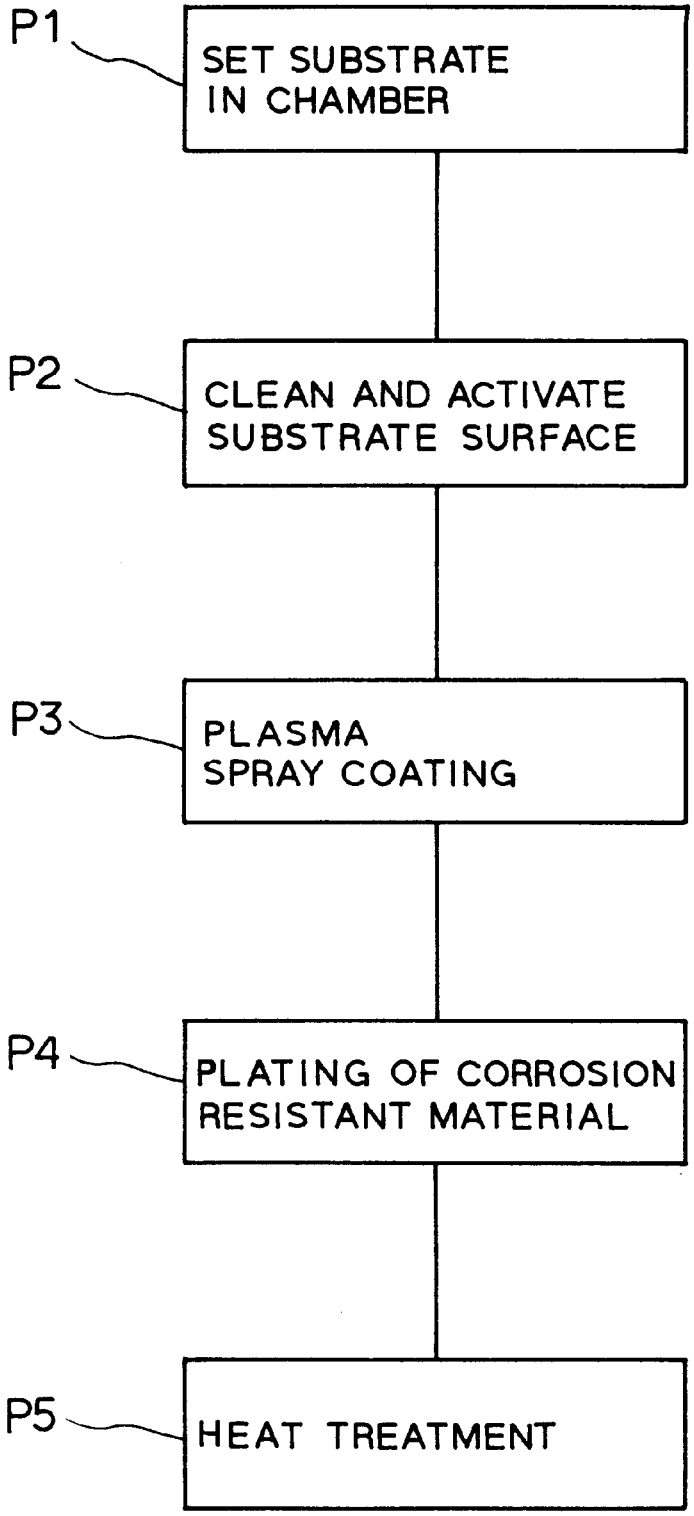
FIG. 1 is a flowchart showing processes of the ceramic coating method according to the present invention.

FIG. 1 is a flowchart showing an embodiment of a production method, according to the present invention, for a ceramic coating material having residual stress due to compression on its surface. This embodiment utilizes, as for the ceramic coating material, an Ni base heat resistant alloy as its substrate, and MCrAlY which is a heat resistant and corrosion resistant alloy and $ZrO_2$ which is a heat resistant and low heat conductive material as its coating material, where M is selected from Fe, Co or Ni. The coating method uses a plasma spray coating method which attains a quick film generation speed and provides a relatively thin film of "mm" order.

Referring to FIG. 1, in a first process P1, the Ni base heat resistant alloy as the substrate is set in a chamber equipped with a plasma spray coating apparatus and the chamber is then evacuated and replacement with Ar gas is performed. In a second process P2, a surface of the substrate to be spray coated is treated with a transferred arc with the substrate as a cathode to clean and activate the surface to be spray coated. At this time, it is performed in the environment having a partial oxygen pressure less than $10^{-3}$ Torr to prevent oxidation of the substrate. In a third process P3, MCrAlY which is the heat resistant and corrosion resistant alloy and $ZrO_2$ which is the heat resistant and low heat conductive ceramic are plasma sprayed over the surface of the substrate at about 500 to 1000° C. At this time, it is performed by changing a supply rate of power for performing the spray coating up to 100% $ZrO_2$ layer of the surface so as to continuously change a composition of the sprayed coating film. The environment for spray coating is kept under a partial oxygen pressure of less than $10^{-3}$ Torr to prevent the metallic component (M) of the MCrAlY from being oxidized when a high temperature heating is performed at the time of the spray coating process.

In a fourth process P4, a chemically stable material such as Pt is coated by a plating method to improve high temperature-resistant oxidation characteristic of the coating material. This plating may be performed, before or after the plasma spray coating process, depending on the kind of the material to be utilized. Finally, in a fifth process P5, this coating material is heat treated under the condition of 600 to 1300° C. and a pressure more than a normal pressure so as to induce residual stress due to the compression in $ZrO_2$ surface. At the same time, the coating film is strengthened by effecting a sintering treatment so that an adhesion property of the coating film is improved by an interdiffusion of metallic elements composing the MCrAlY as the coating material and the Ni base heat resistant alloy as the substrate. As described above, the purpose of performing the treatment under a high pressure is especially to reduce a heating time and to minimize reduction in strength of the substrate due to recrystallization. The setting of the substrate in the chamber in the first process P1 and the cleaning and activation of the substrate surface in the second process P2 may be performed by using a conventional technology and apparatus.

Figure 2:
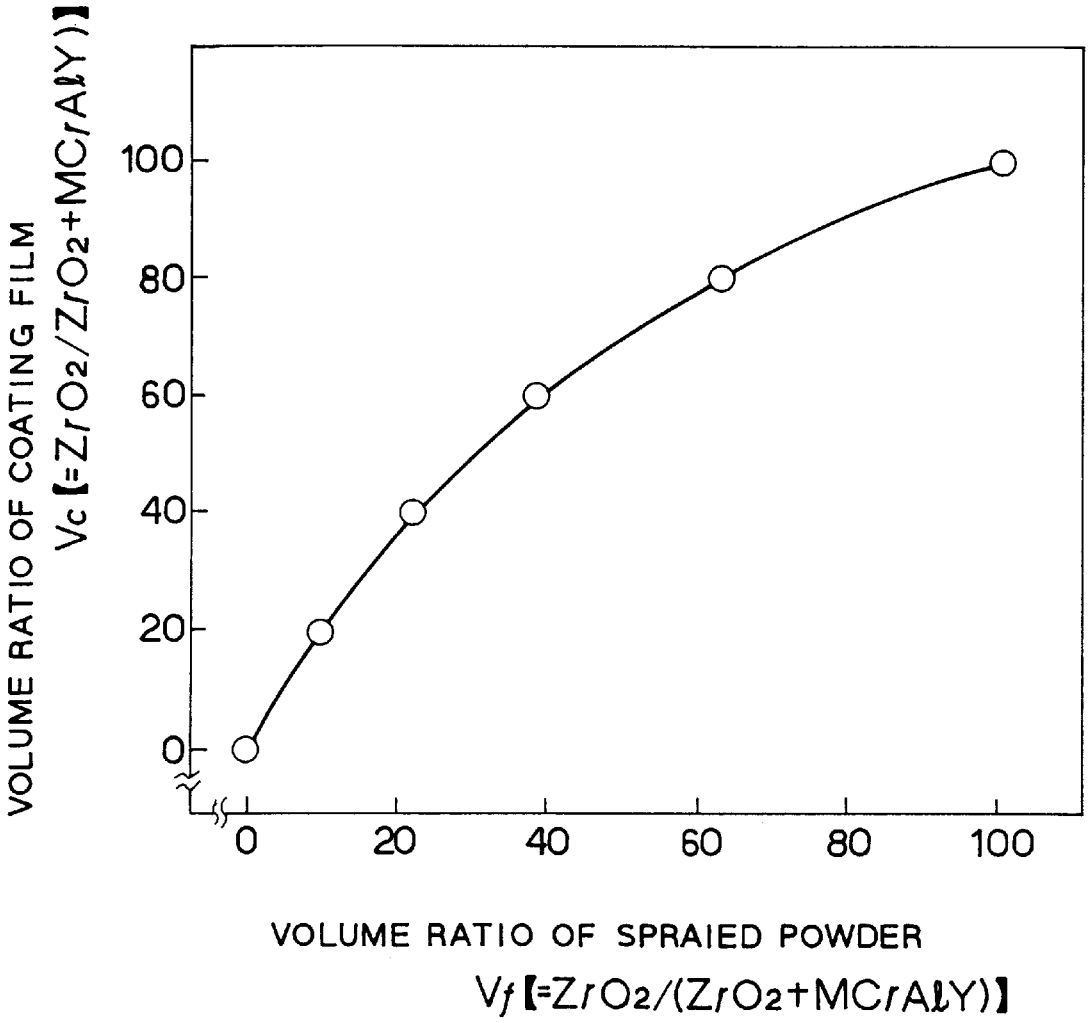
FIG. 2 is a characteristic diagram showing a relationship between a volume ratio of a supplied powder for a spray coating process and a volume ratio of a coating film in accordance with a plasma spray coating method.

The production of the coating film in which the composition ratio of MCrAlY and $ZrO_2$ changes continuously, in the third process P3, is enabled by providing a plurality of ports for powders and changing the supply rate of two spray coating powders, that is, MCrAlY and $ZrO_2$. The production of the coating film having a specified mixture composition is enabled by using a relationship shown in FIG. 2 between a volume ratio Vf for the supplied spray coating powders MCrAlY and $ZrO_2$ and a volume ratio Vc of the coating film of MCrAlY and $ZrO_2$. A thin film is produced by coating while changing the composition ratio of MCrAlY and $ZrO_2$ continuously.

FIG. 3 shows film thickness limit by the time of being peeled a two-layer coating material of the MCrAlY and $ZrO_2$ and a coating material formed by changing the composition of the MCrAlY and $ZrO_2$ continuously. From FIG. 3, it will be apparent that the coating material formed by changing the composition continuously is more difficult to peel by 6 to 10 times in thickness than the two-layer coating material. This is because the residual stress due to tension during the coating process may be reduced by forming the coating material by changing the composition ratio continuously.

In the fourth process P4, the coating process of a platinum group including Pt and Ir and a stable alloying material containing Al capable of forming a passive film such as $Al_2O_3$ and $CrO_2$ may be performed in accordance with conventional plating method. This is possible in principle by such a vapor phase method and spray coating method as the PVD method and CVD method. If the coating layer having a high temperature-resistant oxidation characteristic material is formed in a portion where the coefficient of linear expansion of the mixture composition layer of MCrAlY and that of $ZrO_2$ are equal, only the high temperature-resistant oxidation characteristic can be added while the residual stress due to the compression of $ZrO_2$ being maintained.

The heat treatment in the fifth process P5, may induce the residual stress by the difference between the coefficient of linear expansion of the metallic substrate and that of the coating material.

Figure 4:
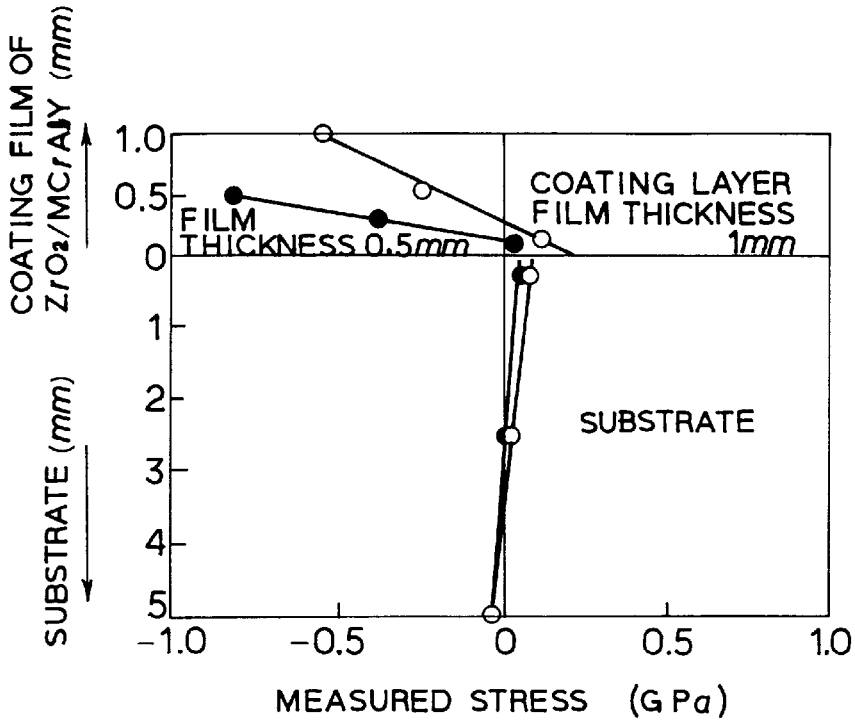
FIG. 4 is a characteristic diagram illustrating a residual stress distribution when a material having a continuously changed composition ratio is formed.
Figure 5:
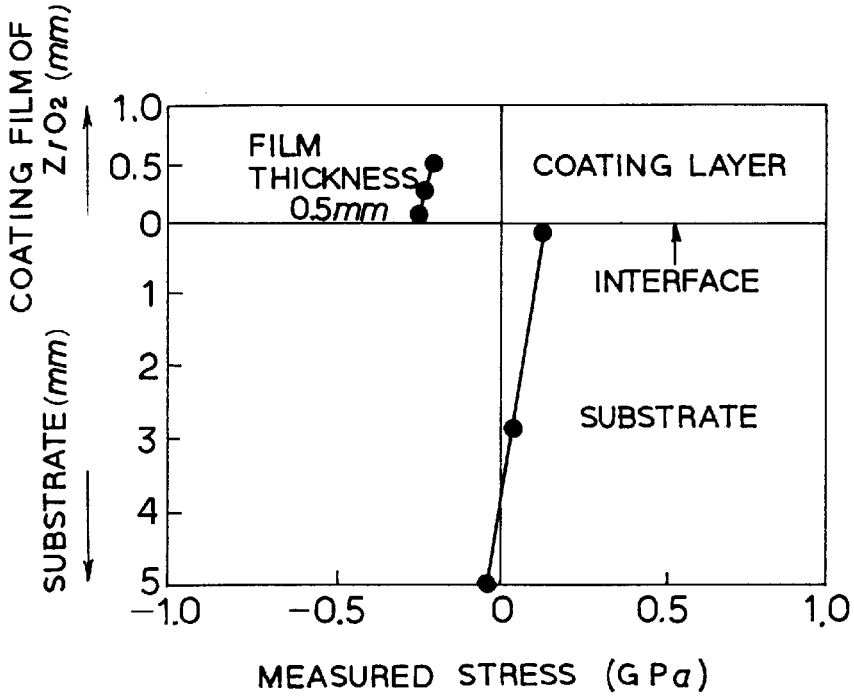
FIG. 5 is a characteristic diagram illustrating the residual stress distribution when a two-layer coating material is formed.

FIGS. 4 and 5 are graphs showing the residual stress distribution, measured by an X-ray method, of the coating material produced in the present processes described above. FIG. 4 shows a case where the coating film is formed by continuously changing the composition ratio of MCrAlY and $ZrO_2$ and FIG. 5 shows a case where the film is formed with two layers. The stress is applied in a direction perpendicular to a direction of plate thickness, thus causing a longitudinal crack of the film. These FIGS. 4 and 5 indicate that the residual stress characteristics at the time of production are remarkably different between a time when the coating film is formed by continuously changing the composition of MCrAlY and $ZrO_2$ and a time when the coating thickness is equal, the residual stress due to the tension applied on an interface between the coating film and the substrate can be reduced and a large residual stress due to the compression may be induced on the coating film surface. The residual stress due to the compression may be increased as the coating thickness is smaller if the substrate thickness is equal. The effects of the material obtained in accordance with the ceramic coating method are explained hereunder.

FIG. 6 shows results of thermal cycle tests of various coating materials, and these tests were performed repeatedly at 1000° C. and 20° C. (maintained for two hours at each temperature) using an infrared heating lamp. Visually remarkable mud-cracks were recognized when repeated once on a two-layer coating film, and when repeated several tens of times in a film coated by continuously changing the composition of MCrAlY and $ZrO_2$, to which the heat treatment was not effected. On the other hand, substantially no change of appearance was recognized even when repeated several hundreds of times in a film coated by continuously changing the composition of MCrAlY and $ZrO_2$, to which the heat treatment was effected. This indicates that the ceramic coating film based on the present coating method can eliminate crack and peeling of the film due to the thermal stress during the use thereof. Namely, the residual stress due to the compression induced on the surface of the ceramic coating film improves the durability of the ceramic coating film during a high temperature operation process.

When the ceramic or mixture composition of the ceramic and a metal is coated, the high temperature-resistant oxidation characteristic can be improved, while the residual stress due to the compression in the ceramic coating film can be maintained, by coating a platinum group element such as Pt or Ir, or a stable alloying material containing Al or Cr forming such as stable passive film as $Al_2O_3$ and $Cr_2O_3$ at a portion having an equal coefficient of the linear expansion.

According to this heat treatment, the coating film strength can be improved by the coating film sintering process and the element diffusion between the coating material and the substrate, and the adhesion property between the coating material and the substrate can be also improved. Thus, an erosion characteristic of the coating film and the durability of the coating film during the high temperature operation can be improved.

Next, other embodiments in which the coating material obtained in accordance with the first embodiment described above is applied as a part of a gas turbine which is operated in a high temperature oxidation environment will be described hereunder.

Figure 7:
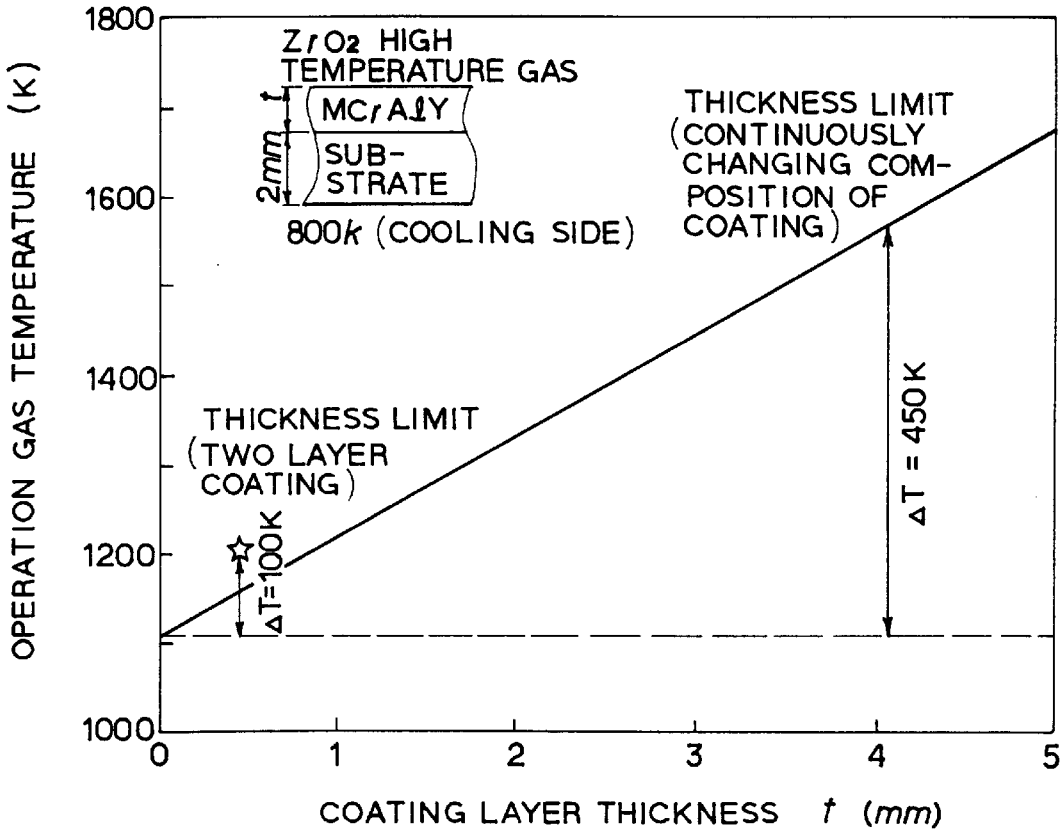
FIG. 7 is an explanatory view showing a thermal shielding effect of metallic substrate with the coating of the present invention.

FIG. 7 shows a thermal shielding effect when the coating material in accordance with the present coating method is applied to a portion of a gas turbine, which is in contact with the high temperature gas. In the graph of FIG. 7, operating gas temperatures corresponding to a coating material thickness are plotted when the substrate thickness is 2.2 mm, the cooling gas temperature is 800 K and the substrate surface temperature is 973 K. In the coating film formed by continuously changing the mixture composition of MCrAlY and $ZrO_2$, the thermal shielding effect clearly increases in almost linear relationship as the thickness increases.

The thermal shielding effect of the coating film formed by continuously changing the mixture compositions of MCrAlY and $ZrO_2$ in accordance with the coating method of the present invention will be compared hereunder with that of the conventional two-layer coating material of MCrAlY and $ZrO_2$.

To the two-layer coating material, peelings of the coating film about 0.5 mm in the coating process are caused and accordingly, the maximum thermal shielding effect is about 100 K in the temperature drop. On the other hand, in the coating process in which the mixture composition of MCrAlY and $ZrO_2$ is continuously changed from the metallic material to the coating surface, a film about 4 mm in thickness is formed due to the residual stress relaxation and the high tenacity of its intermediate layer. Consequently, the coating film may be given with a thermal shielding effect of about 450 K. Thus, the gas temperature of the gas turbine is raised and the cooling gas amount is reduced, improving the operating efficiency.

As described above, according to the present invention, the residual stress due to the compression may be induced on the ceramic coating film surface in the ceramic coating process onto the metallic substrate, so that a ceramic coating material free of cracks and peeling and having excellent durability may be produced. Furthermore, if this material is applied to a portion of a gas turbine which is in contact with a high temperature combustion gas, an effective gas turbine operation is enabled because the gas temperature is raised and the cooling gas amount is reduced.

What is claimed is:

1. A ceramic coating method for coating a ceramic on a metallic substrate comprising the steps of:

coating a ceramic material on a surface of the metallic substrate by continuously changing a composition of a ceramic material and a metal to form a ceramic coated film of a ceramic oxides wherein said metallic substrate is formed of a heat resistant alloy of an element selected from the group consisting of Fe, Co and Ni; and wherein said metallic substrate has a larger coefficient of linear expansion in comparison with that of the ceramic oxide; and subsequently heat treating the ceramic coated metallic substrate at a temperature higher than a softening point of the metal so as to induce a residual stress due to compression on a surface of the ceramic coating film at a time of cooling the ceramic coated metallic substrate, thereby improving a durability of the ceramic coating film.

2. A ceramic coating method according to claim 1, wherein said ceramic oxide is a metallic oxide of $Al_2O_3$, $ZrO_2$, and $HfO_2$, a ceramic oxide into which another ceramic oxide is dissolved for a phase stability, or a compound of ceramic oxide of $ZrSiO_4$ and $AlSiO_5$.

3. A ceramic coating method according to claim 1, wherein a metal component of the mixture composition of the ceramic and a metal of an intermediate layer formed during the continuous coating process between the surface of the substrate and a final coating surface is formed of a heat resistant alloy of element substantially selected from a group consisting of Fe, Co or Ni.

4. A ceramic coating method according to claim 1, wherein the ceramic material is coated on the surface of the metallic substrate by means of a plasma spray coating method.

5. A ceramic coating method according to claim 1, wherein the mixture composition of the ceramic and the metal is coated on the surface of the metallic substrate by means of a plasma spray coating method.

6. A ceramic coating method according to claim 5, wherein the ceramic coating film of the mixture composition of the ceramic and the metal is formed under an environment having a partial oxygen pressure of less than $10^{-3}$ Torr.

7. A ceramic coating method according to claim 1, wherein the heat treatment is effected with a temperature within 600–1300° C.

8. A ceramic coating method according to claim 1, wherein the heat treatment is effected at a pressure more than a normal pressure to carry out an HIP treatment.

9. A ceramic coating method according to claim 1, further comprising a step of coating a high temperature resistant oxidizing material film to improve the high temperature resistant oxidization characteristic of the coating material.

10. A ceramic coating method according to claim 9, wherein the temperature resistant oxidizing material film is coated during the coating process of the ceramic material.

11. A ceramic coating method according to claim 9, wherein the temperature resistant oxidizing material film is coated after the coating process of the ceramic material.

12. A ceramic coating method according to claim 9, wherein the temperature resistant film is prepared from a material selected from a platinum group element.

13. A ceramic coating method according to claim 12, wherein the platinum group element is Pt or Ir.

14. A ceramic coating method according to claim 9, wherein the temperature resistant film is prepared from a stable alloying material forming a stable passive film.

15. A ceramic coating method according to claim 14, wherein the stable alloying material is Al or Cr and the stable passive film is formed of $Al_2O_3$ or $Cr_2O_3$ at a portion having an equal coefficient linear expansion when the ceramic or mixture composition of the ceramic and the metal is coated.

* * * * *